US007906912B2

(12) United States Patent
Ishii et al.

(10) Patent No.: US 7,906,912 B2
(45) Date of Patent: Mar. 15, 2011

(54) MAGNETRON

(75) Inventors: Takeshi Ishii, Tochigi (JP); Nagisa Kuwahara, Tochigi (JP); Masayuki Aiga, Hyogo (JP)

(73) Assignee: Panasonic Corporation, Osaka (JP)

( * ) Notice: Subject to any disclaimer, the term of this patent is extended or adjusted under 35 U.S.C. 154(b) by 655 days.

(21) Appl. No.: 11/976,492

(22) Filed: Oct. 25, 2007

(65) Prior Publication Data

US 2008/0100220 A1 May 1, 2008

(30) Foreign Application Priority Data

Oct. 25, 2006 (JP) ..... P. 2006-290470

(51) Int. Cl.
*H01J 25/50* (2006.01)

(52) U.S. Cl. ..... 315/39.51; 315/39.71; 315/39.77

(58) Field of Classification Search ..... 315/39.51, 315/39.63, 39.67, 39.71, 39.77
See application file for complete search history.

(56) References Cited

U.S. PATENT DOCUMENTS

| | | | | |
|---|---|---|---|---|
| 4,855,645 | A * | 8/1989 | Kinuno et al. | 315/39.71 |
| 4,891,557 | A * | 1/1990 | Nobue et al. | 315/39.51 |
| 5,021,713 | A * | 6/1991 | Uesawa et al. | 315/39.51 |
| 5,049,782 | A * | 9/1991 | Aiga et al. | 315/39.51 |
| 5,357,168 | A * | 10/1994 | See | 315/39.51 |
| 5,635,798 | A * | 6/1997 | Ogura et al. | 315/39.71 |
| 6,501,224 | B2 * | 12/2002 | Miki et al. | 315/39.71 |
| 2002/0043937 | A1 * | 4/2002 | Ogura et al. | 315/39.51 |

FOREIGN PATENT DOCUMENTS

| | | |
|---|---|---|
| JP | 61-263028 | 11/1986 |
| JP | 01-173548 | 7/1989 |
| JP | 02-144826 | 6/1990 |
| JP | 63-18745 U | 2/1998 |
| WO | WO 79/00329 | 6/1979 |

OTHER PUBLICATIONS

Chinese Office Action, w/ English translation thereof, issued in Chinese Patent Application No. CN 200710159601.7 dated Dec. 11, 2009.

European Search Report issued in European Patent Application No. EP 07118655.5-2208/1926348, dated May 13, 2009.

* cited by examiner

*Primary Examiner* — Douglas W Owens
*Assistant Examiner* — Tung X Le
(74) *Attorney, Agent, or Firm* — McDermott Will & Emery LLP

(57) ABSTRACT

The magnetron includes: a cylindrical-shaped anode barrel member 10 having two openings respectively formed in the two end portions thereof; a cathode structure member 12 disposed on the center axis of the anode barrel member 10; more than one anode vane 11 disposed radially through an action space 13 in the periphery of the cathode structure member 12 and fixedly mounted on the inner wall surface of the anode barrel member 10; and, a pair of funnel-shaped pole pieces 14 and 30 respectively disposed in their associated ones of the two openings formed in the two end portions of the anode barrel member 10, each pole piece including a small-diameter flat portion FL1 having a penetration hole formed in the central portion thereof, a large-diameter flat portion FL2 having a diameter larger than the diameter of the small-diameter flat portion FL1, and a conical-shaped slanting portion SL for connecting the large-diameter flat portion FL2 and small-diameter flat portion FL1 to each other. Of the pair of pole pieces 14 and 30, the input side pole piece 30 includes, besides the penetration hole 30A formed in the central portion thereof, three or more, preferably, four penetration holes 30B respectively formed in the slanting portion SL thereof, each hole having an area of 16.6 $mm^2$.

5 Claims, 13 Drawing Sheets

| HOLE NUMBER / HOLE DIAMETER(MM) | | 1 | 2 | 3 | 4 |
|---|---|---|---|---|---|
| 6.5 | AREA OF HOLE<br>MAXIMUM MAGNETIC FIELD STRENGTH | 33.2<br>181.8 | 66.4<br>181.6 | 99.5<br>181.4 | 132.7<br>181.3 |
| 4.6 | AREA OF HOLE<br>MAXIMUM MAGNETIC FIELD STRENGTH | 16.6<br>182.2 | 33.2<br>182.1 | 49.9<br>182 | 66.5<br>181.8 |
| 4.2 | AREA OF HOLE<br>MAXIMUM MAGNETIC FIELD STRENGTH | 13.9<br>182.4 | 27.7<br>182.4 | 41.6<br>182.4 | 55.4<br>182.2 |
| 3.8 | AREA OF HOLE<br>MAXIMUM MAGNETIC FIELD STRENGTH | 11.3<br>182.4 | 22.7<br>182.4 | 34.0<br>182.4 | 45.4<br>182.4 |
| 3.3 | AREA OF HOLE<br>MAXIMUM MAGNETIC FIELD STRENGTH | 8.6<br>182.4 | 17.1<br>182.4 | 25.7<br>182.4 | 34.2<br>182.4 |

FIG. 9

| | AXIAL-DIRECTION MEASURING PORTION | | HOLE NUMBER 1 | HOLE NUMBER 4 |
|---|---|---|---|---|
| PORTION WHERE ONE OR MORE HOLES ARE FORMED | 6 | 127.3 | 140 | 116 |
| | 5 | 147.7 | 160.4 | 141.8 |
| | 4 | 166.4 | 173 | 160.6 |
| | 3 | 174.9 | 179.2 | 171.3 |
| | 2 | 180 | 181.3 | 177.8 |
| | 1 | 182.2 | 181.8 | 180.4 |
| | 0 | 182.4 | 180.5 | 181.3 |
| | −1 | 181.2 | 176.8 | 180.4 |
| | −2 | 177.4 | 171.8 | 177.1 |
| | −3 | 169.8 | 159.2 | 171.5 |
| | −4 | 158.2 | 139.7 | 161.2 |
| | −5 | 140 | 117.2 | 144.6 |
| | −6 | 113.4 | 91 | 117.2 |
| PORTION WHERE NO HOLE IS FORMED | −6 | 127.3 | 115.1 | 115.8 |
| | −5 | 147.7 | 140.3 | 140.9 |
| | −4 | 166.4 | 161.3 | 161.2 |
| | −3 | 174.9 | 172.4 | 170.3 |
| | −2 | 180 | 178.9 | 176.3 |
| | −1 | 182.2 | 181.5 | 180.1 |
| | 0 | 182.4 | 182.3 | 180.9 |
| | 1 | 181.2 | 180.9 | 180.9 |
| | 2 | 177.4 | 177.3 | 177.6 |
| | 3 | 169.8 | 172.6 | 172.1 |
| | 4 | 158.2 | 160.4 | 161.6 |
| | 5 | 140 | 143.2 | 144.9 |
| | 6 | 113.4 | 116.1 | 118.1 |

MAGNETRON

BACKGROUND OF THE INVENTION

1. Field of the Invention

The present invention relates to a magnetron for used in equipment using microwaves such as a microwave oven.

2. Description of the Related Art

FIG. 15 is a longitudinal section view of a general magnetron which is conventionally used in a microwave oven, and FIG. 16 is an enlarged section view of the main portions of the magnetron shown in FIG. 15. In FIGS. 15 and 16, in the inside of a cylindrical-shaped anode barrel member 10, there are radially disposed anode vanes 11, while spaces respectively enclosed by the mutually adjoining anode vanes 11 and anode barrel member 10 constitute a cavity resonator. In the central portion of the anode barrel member 10, there is disposed a cathode structure member 12, while a space enclosed by the anode structure member 12 and anode vane 11 constitutes an action space 13. On the upper end of the anode barrel member 10, there is fixedly mounted a pole piece (which is hereinafter referred to as an output side pole piece) 14, whereas, on the lower end thereof, there is fixedly mounted another pole piece (which is hereinafter referred to as an input side pole piece) 15.

The output side pole piece 14 is formed in a funnel shape by drawing a magnetic plate member having small magnetic resistance such as an iron plate member. That is, the output side pole piece 14 provides a funnel shape which includes a small-diameter flat portion FL1 having a penetration hole 14A formed in the central portion thereof, a large-diameter flat portion FL2 having a larger diameter than the small-diameter flat portion FL1, and a conical-shaped slanting portion SL which connects together the large-diameter and small-diameter flat portions FL2 and FL1. In the output side pole piece 14, besides the penetration hole 14A formed in the central portion thereof, there is also formed another penetration hole 14B through which an antenna 16 can be penetrated.

The input side pole piece 15, similarly to the output side pole piece 14, is formed in a funnel shape by drawing a magnetic plate member having small magnetic resistance such as an iron plate member. That is, the input side pole piece 15 provides a funnel shape which includes a small-diameter flat portion FL1 having a penetration hole 14A formed in the central portion thereof, a large-diameter flat portion FL2 having a larger diameter than the small-diameter flat portion FL1, and a conical-shaped slanting portion SL which connects together the large-diameter and small-diameter flat portions FL2 and FL1. Just above the output side pole piece 14, there is disposed a metal ring 17 which covers the output side pole piece 14, while, just below the input side pole piece 15, there is disposed a metal ring 18 for covering the input side pole piece 15. Just above the metal ring 17 and just below the metal ring 18, there are respectively mounted ring-shaped magnets (not shown) in a close contact manner, the central portions of both of which are formed hollow. To the cathode structure member 12, there is connected a lead 19 which is used to apply a direct current voltage to the cathode structure member 12.

When using the conventional magnetron, after the inside of the magnetron is evacuated, a direct current high voltage is applied to between the anode vane 11 and cathode structure member 12. In the action space 13, there is formed a magnetic field due to the two magnets (not shown). When the direct current high voltage is applied to and between the anode vane 11 and cathode structure member 12, electrons are drawn out from the cathode structure member 12 and thus they fly out toward the anode vane 11. At the then time, the magnetic field due to the two magnets (not shown) concentrates in a gap existing between the output side pole piece 14 and input side pole piece 15, and it acts on the action space 13 in a direction perpendicular to a direction where the cathode structure member 12 and anode barrel member 10 are opposed to each other. As a result of this, electrons flown out from the cathode structure member 12 are rotated and moved in a spiral by a force which is generated by the magnetic field due to the magnets (not shown), and the electrons finally arrive at the anode vane 11. Energy generated due to the then time electrons movements is applied to the cavity resonator to contribute toward the oscillation of the magnetron.

By the way, when discharging the air existing in the inside of the magnetron, the air on the input side, as shown in FIG. 17, passes not only through a penetration hole 15A opened up in the central portion of the input side pole piece 15 but also through a penetration hole 21A opened up in a lower end hat 21 which constitutes the cathode structure member 13. Since the lower end hat 21 is situated in the penetration hole 15A of the input side pole piece 15 and one end portion of a filament coil 22 is situated in the penetration hole 21A of the lower end hat 21, the portions of the penetration holes 15A and 21A, through which the air passes, are made narrow. This makes it impossible to provide a large air discharge conductance (an air exhaust efficiency), thereby taking much time to discharge the air. Owing to the fact that it takes much time for the air exhaust, there is a fear that there can occur a poor degree of vacuum. To solve this problem, there is proposed a structure in which an output side pole piece having a penetration hole 14B, through which the antenna 16 is to be passed, is employed as an input side pole piece to thereby increase the air discharge conductance (for example, see Japanese Utility Model Publication Sho-63-18745). The air, which has passed through the input side pole piece 15 and flowed into the inside of the anode barrel member 10, is discharged from an exhaust pipe 20 through the penetration hole 14A opened up in the central portion of the output side pole piece 14 as well as through the penetration hole 14B opened up for the passage of the antenna therethrough.

However, even when there is disposed a new opening in the input side pole piece 15 (there may also be the output side pole piece 14) in order to discharge the air on the input side with high efficiency, depending on the size of the opening, there is also a fear that the maximum magnetic field strength can be lowered or higher harmonic waves can leak.

SUMMARY OF THE INVENTION

The present invention is made in view of the above conventional circumstances. Thus, it is an object of the invention to provide a magnetron which can increase the air exhaust conductance without lowering the maximum magnetic field strength or causing the leakage of the higher harmonic waves.

The above object can be attained by the following structure and method.

(1) A magnetron, comprising: a cylindrical-shaped anode barrel member having two openings respectively formed in the two end portions thereof; a cathode structure member disposed on the center axis of the anode barrel member; more than one anode vane disposed radially through an action space in the periphery of the cathode structure member and fixedly mounted on the inner wall surface of the anode barrel member; and, a funnel-shaped input side pole piece disposed on the side of one of the two openings of the anode barrel member for supply of power to the cathode structure member, the input side pole piece including a small-diameter flat portion having a penetration hole formed in the central portion thereof, a large-diameter flat portion having a diameter larger than the diameter of the small-diameter flat portion, and a conical-shaped slanting portion for connecting the large-diameter flat portion and small-diameter flat portion to each other, wherein the input side pole piece further includes, besides the penetration hole formed in the central portion of the small-diameter flat portion, three or more penetration holes respectively formed in the slanting portion thereof.

(2) A pole piece manufacturing method for manufacturing a magnetron comprising: a cylindrical-shaped anode barrel member having two openings respectively formed in the two end portions thereof; a cathode structure member disposed on the center axis of the anode barrel member; more than one anode vane disposed radially through an action space in the periphery of the cathode structure member and fixedly mounted on the inner wall surface of the anode barrel member; and, a funnel-shaped input side pole piece disposed on the side of one of the two openings of the anode barrel member for supply of power to the cathode structure member, the input side pole piece including a small-diameter flat portion having a penetration hole formed in the central portion thereof, a large-diameter flat portion having a diameter larger than the diameter of the small-diameter flat portion, and a conical-shaped slanting portion for connecting the large-diameter flat portion and small-diameter flat portion to each other, wherein there is formed a penetration hole over the large-diameter flat portion and slanting portion of the input side pole piece so as to extend in the axial direction of the input side piece pole.

(3) In the pole piece manufacturing method as set forth in the above item (2), the area of the penetration hole is 16.6 $mm^2$ or smaller and three or more such penetration holes are formed at given intervals in the peripheral direction of the slanting portion of the input side pole piece.

According to the magnetron as set forth in the above item (1), since the input side pole piece has three or more penetration holes in the slanting portion thereof, a large air conductance can be provided, thereby being able to shorten the air exhaust time to discharge the air existing in the inside of the magnetron. Also, because the air of the inside of the magnetron can be discharged positively, the occurrence of a poor degree of vacuum within the magnetron can also be prevented. Further, since the area of each penetration hole is set for 16.6 $mm^2$ or smaller, the lowering of the maximum magnetic field strength and the leakage of higher harmonic waves can be prevented.

According to the magnetron pole piece manufacturing method as set forth in the above item (2), since the penetration hole is formed in the axial direction (that is, in the vertical direction) over the large-diameter flat portion and slanting portion of the input side pole piece, the penetration hole can be formed simultaneously when the input side pole piece is manufactured by press working, which can minimize an increase in the cost for forming the penetration hole.

According to the magnetron pole piece manufacturing method as set forth in the above item (3), since three or more penetration holes are formed at given intervals in the peripheral direction of the slanting portion, a large air exhaust conductance can be secured when the magnetron is in operation, which makes it possible to shorten the air exhaust time to discharge the air existing in the inside of the magnetron. Also, because the air of the inside of the magnetron can be discharged positively, the occurrence of a poor degree of vacuum within the magnetron can also be prevented. Further, since the area of each penetration hole is set for 16.6 $mm^2$ or smaller, the lowering of the maximum magnetic field strength and the leakage of higher harmonic waves can be prevented.

Also, in the case of a microwave using apparatus according to the invention, since it includes the above-mentioned magnetron, the air exhaust time can be shortened as well as the stable operation of the apparatus can be realized.

BRIEF DESCRIPTION OF THE DRAWINGS

FIG. 9 is an explanatory view of an experiment conducted about the magnetic field distortion (magnetic field strength measured result values).

DESCRIPTION OF THE PREFERRED EMBODIMENTS

Now, description will be given below in detail of a preferred embodiment of a magnetron according to the invention with reference to the accompanying drawings.

Figure 1:
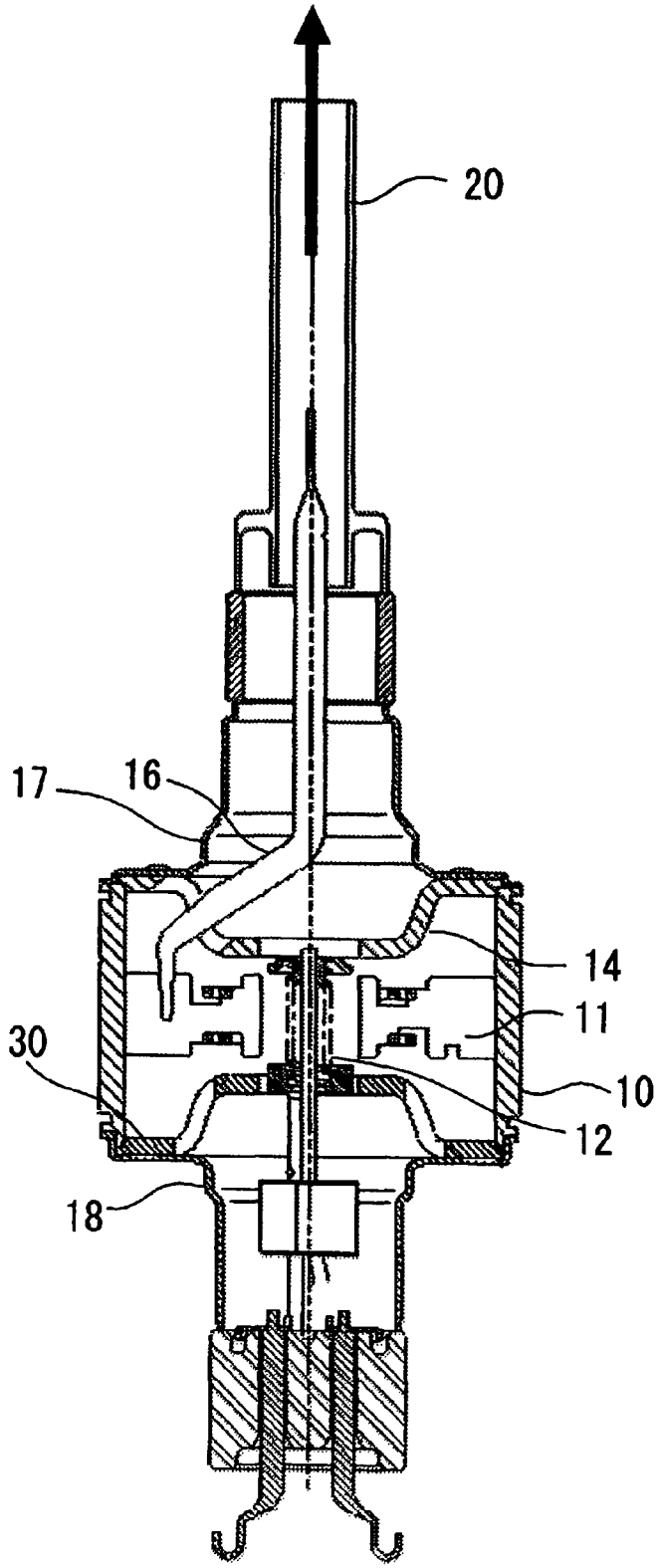
FIG. 1 is a longitudinal section view of a magnetron according to an embodiment of the invention.
Figure 2:
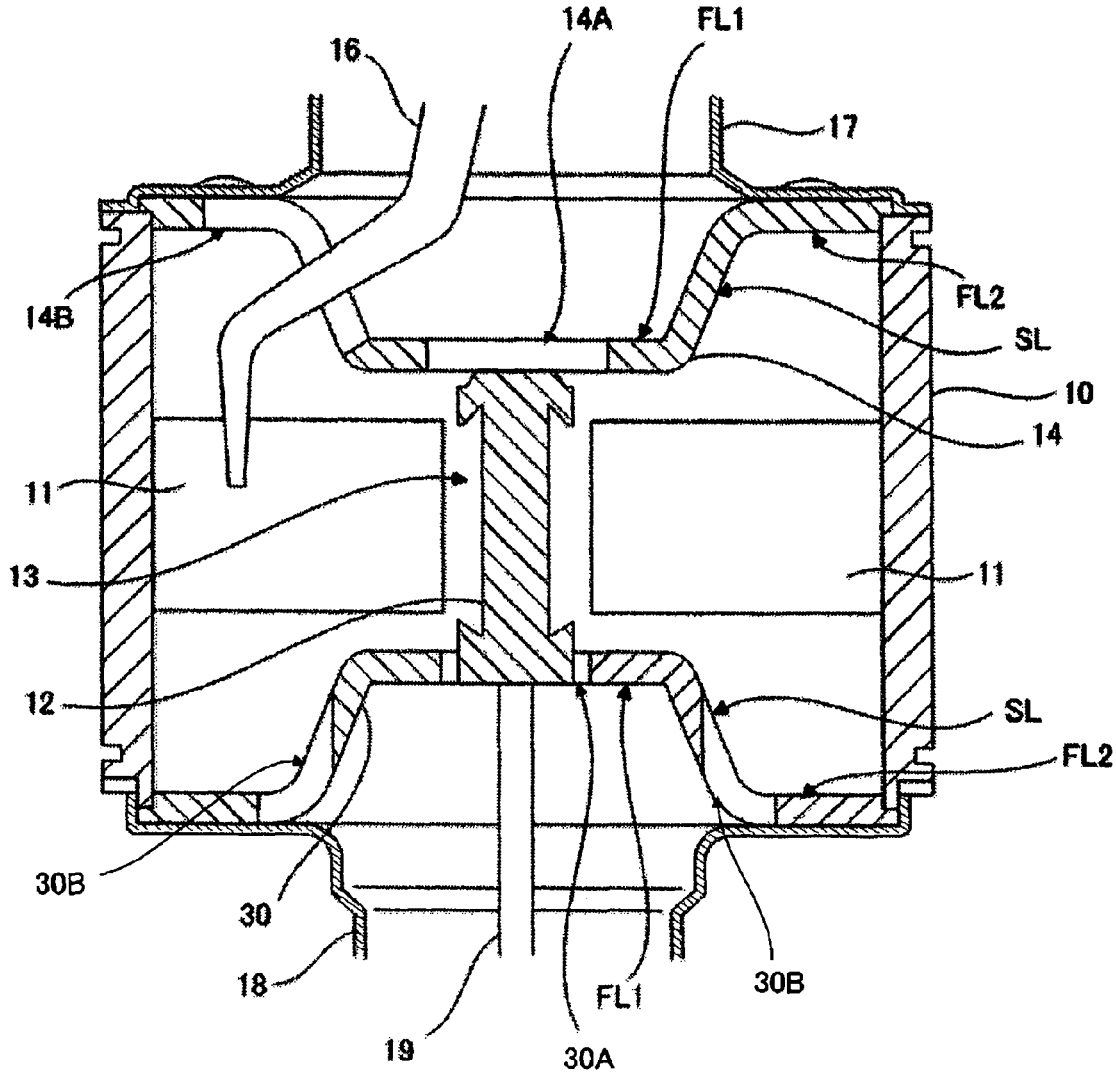
FIG. 2 is an enlarged section view of the main portions of the magnetron shown FIG. 1.

FIG. 1 is a longitudinal section view of a magnetron according to an embodiment of the invention, while FIG. 2 is an enlarged section view of the main portions of the magnetron shown in FIG. 1. In FIG. 2, the magnetron according to the present embodiment comprises: a cylindrical-shaped anode barrel member 10 having two openings respectively formed in two end portions thereof; a cathode structure member 12 disposed on the center axis of the anode barrel member 10; more than one anode vane 11 disposed radially through an action space 13 in the periphery of the cathode structure member 12 and fixedly mounted on the inner wall surface of the anode barrel member 10; and a pair of funnel-shaped pole pieces 14 and 30 respectively disposed in their associated ones of the two openings respectively formed in the two end portions of the anode barrel member 10, each pole piece including a small-diameter flat portion FL1 having a penetration hole formed in the central portion thereof, a large-diameter flat portion FL2 having a diameter larger than the diameter of the small-diameter flat portion FL1, and a conical-shaped slanting portion SL for connecting the large-diameter flat portion FL2 and small-diameter flat portion FL1 to each other. Of the pair of pole pieces 14 and 30, the output side pole piece 14, which is disposed on the side where an antenna 16 is arranged, further includes, besides the penetration hole 14A formed in the central portion thereof, a penetration hole 14B through which the antenna 16 can be penetrated; and, the input side pole piece 30 disposed on the side for supply of power to the cathode structure member 12 includes, besides the penetration hole 30A formed in the central portion thereof, three or more, preferably, four penetration holes 30B formed in its slanting portion SL, each penetration hole 30B having an area of 11.5 $mm^2$.

The penetration hole 30A, which is formed in the central portion of the input side pole piece 30, is similar in size to one formed in the conventional magnetron.

The four penetration holes 30B of the slanting portion SL are formed at 90° intervals in the peripheral direction of the slanting portion SL and extend in the axial direction (that is, in the vertical direction) over the large-diameter flat portion FL2 and slanting portion SL. Thanks to such formation of the penetration holes 30B, when producing the input side pole piece 30 by press working, the four penetration holes 30B together with the penetration hole 30A formed in the central portion can be formed simultaneously, which can minimize an increase in the cost for forming the four penetration holes 30B. By the way, when trying to form a penetration hole perpendicularly to the surface of the slanting portion SL, generally, there is necessary press working which uses a cam die. Especially, in the case of a progressive metal mold, there is necessary a metal mold installation space for each hole, which requires a large space and thus increases the cost for formation of holes.

Thanks to new formation of the four penetration holes 30B in the input side pole piece 30, the air existing on the input side can be discharged with high efficiency and thus a large air exhaust conductance can be secured. Also, owing to the fact that each of the penetration holes 30B is formed to have a size of 11.5 $mm^2$, it has been found by an experiment that the magnetic field distribution cannot be distorted and the magnetic field strength cannot be lowered.

Figures 3, 4:
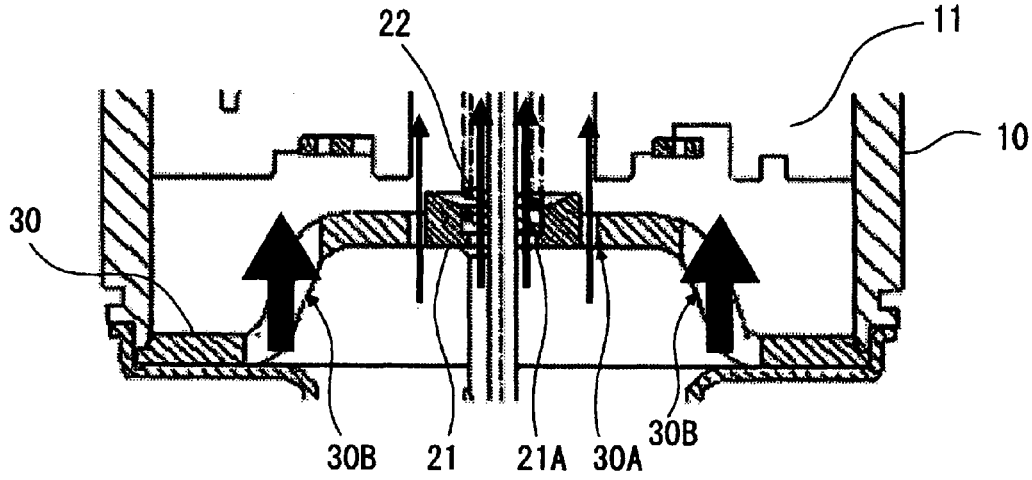
FIG. 3 is a view to show how the air passes in an input side pole piece employed in the magnetron shown in FIG. 1.
FIG. 4 is a view of an example of the experimental results of variations in the maximum magnetic field strength caused by the different number of penetration holes and the different diameters of penetration holes opened up in the input side pole piece shown in FIG. 1.

When discharging the air existing in the inside of the magnetron, the air on the input side, as shown in FIG. 3, passes through the penetration hole 30A formed in the central portion of the input side pole piece 30, the four penetration holes 30B formed in the slanting portion SL, and a penetration hole 21A opened up in a lower end hat 21 which constitutes the cathode structure member 13, respectively. Especially, since a large amount of air passes through the newly formed four penetration holes 30B, there can be provided a large air exhaust conductance (air exhaust efficiency). This can shorten the time necessary for the air exhaust and also can prevent occurrence of a poor degree of vacuum.

Next, description will be given of the results of the experiment conducted by the inventors.

FIG. 4 shows the experimentally obtained results of the relationships between the hole diameter/hole number and the magnetic strength. In this case, the number of holes is up to four, while the diameters of the holes are respectively set for 3.3 mm, 3.8 mm, 4.2 mm, 4.6 mm, and 6.5 mm. In FIG. 4, for example, when the hole diameter is 6.5 mm and the hole number is 1, the area of the hole provides 33.2 $mm^2$ and the maximum magnetic field strength provides 181.8 mT; and, when the hole diameter is 6.5 mm and the hole number is three, the hole area provides 99.5 $mm^2$ and the maximum magnetic field strength provides 181.4 mT. Also, when the hole diameter is 4.2 mm and the hole number is 1, the hole area provides 13.9 $mm^2$ and the maximum magnetic field strength provides 182.4 mT, and, when the hole diameter is 4.2 mm and the hole number is 3, the hole area provides 41.6 $mm^2$ and the maximum magnetic field strength provides 182.4 mT By the way, although not shown in FIG. 4, for no hole, the maximum magnetic field strength provides 182.4 mT.

Figure 5:
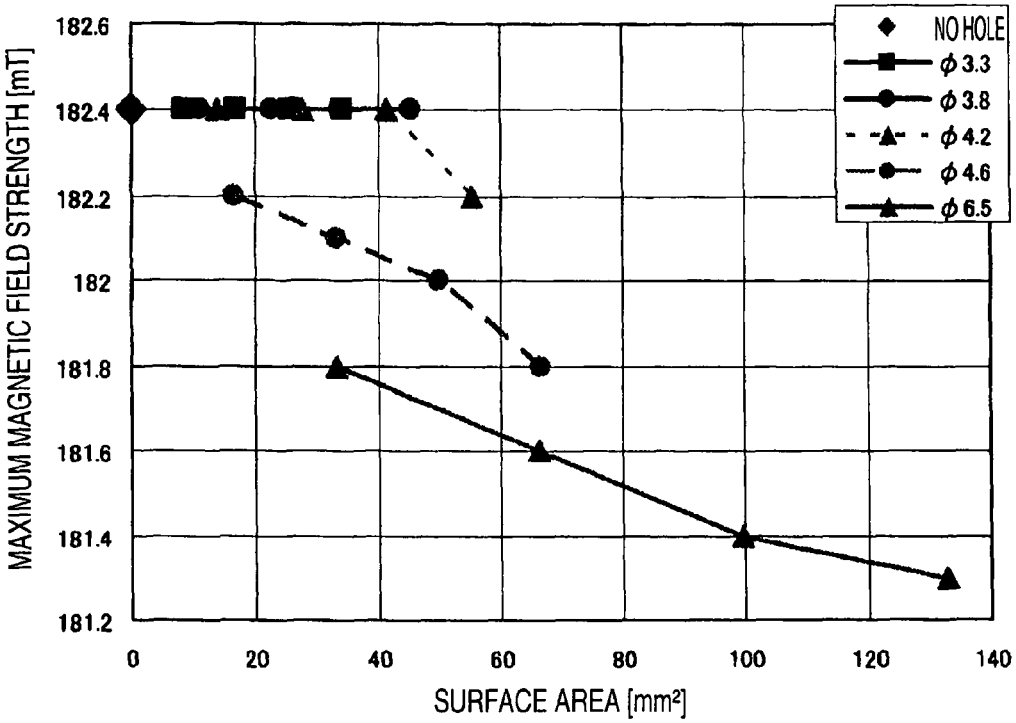
FIG. 5 is a graphical representation of the relationship between the surface area(s) of the hole(s) and the maximum magnetic field strength based on the experimental results shown in FIG. 4.
Figure 6:
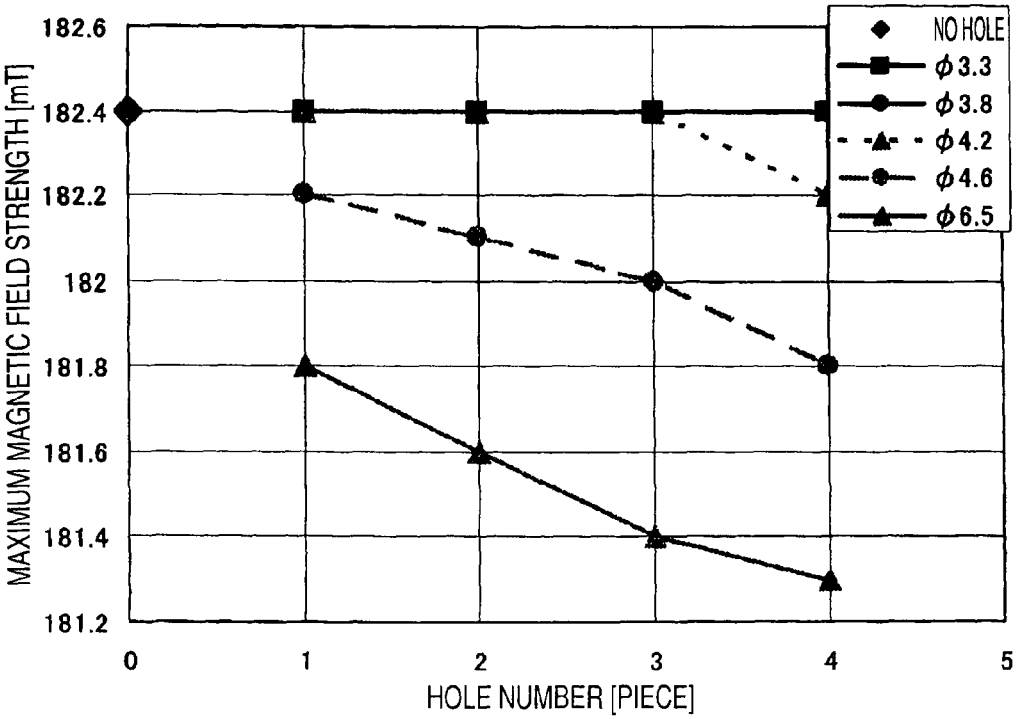
FIG. 6 is a graphical representation of the relationship between the number of holes and the maximum magnetic field strength based on the experimental results shown in FIG. 4.

Now, FIGS. 5 and 6 are respectively graphical representations of the results that have been obtained in the above experiment. Specifically, FIG. 5 shows the relationship between the hole area ($mm^2$) and the maximum magnetic field strength (mT), and FIG. 6 shows the relationship between the hole number (piece) and the maximum magnetic field strength (mT). As can be seen from FIG. 5, when the hole diameter is equal to or smaller than 4.2 mm, the maximum magnetic field strength (mT) shows a good value. Also, as can be seen from FIG. 6, for the hole diameter equal to or smaller than 4.2 mm, even when the hole number (piece) is set for four, the maximum magnetic field strength (mT) shows a good value.

As the hole diameter increases, even when the area is the same, the maximum magnetic field strength decreases. That is, the maximum magnetic field strength decreases when the hole area per hole is equal to or larger than 16.6 ($mm^2$). Also, for the same hole area, when the area per hole decreases and the hole number increases, the maximum magnetic field strength is hard to decrease.

Figure 10:
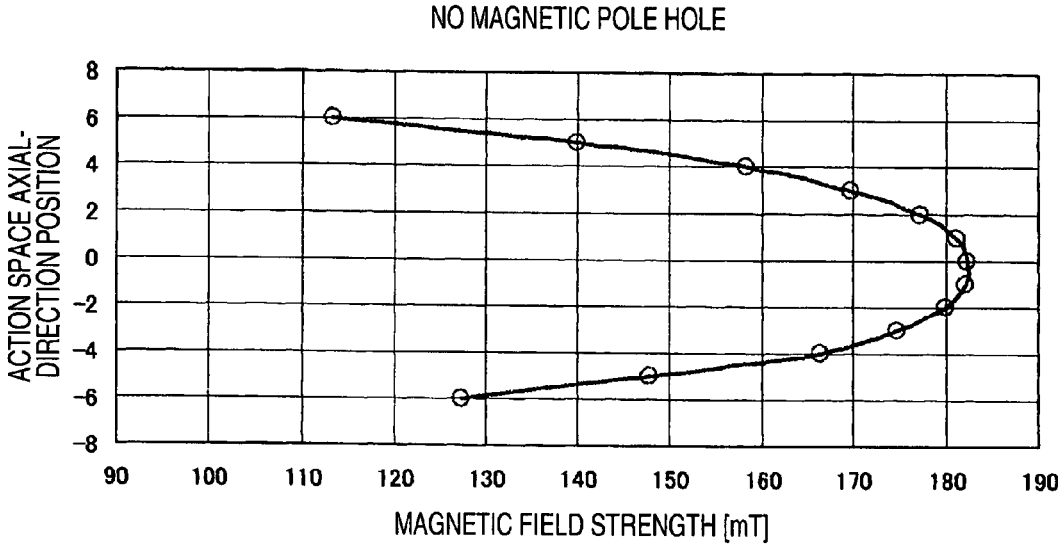
FIG. 10 is an explanatory view of an experiment conducted about the magnetic field distortion (a graph 1 showing the magnetic field strength measured results).

Now, FIGS. 7 to 12 respectively show the results as to the magnetic field distortion that have been obtained by experiments. FIG. 7A shows an input side pole piece having no other penetration hole than a penetration hole formed in the central portion thereof and a diameter-direction measuring portion Ph1 corresponding to the penetration hole. This input side pole piece is similar to the conventional input side pole piece and, therefore, a reference numeral 15 is given to it. FIG. 10 is a graphical representation which shows the results obtained by measuring the magnetic field strength, at the position of the diameter-direction measuring portion Ph1, in the respective axial-direction measuring portions Pv-8~pv8 respectively shown in FIG. 8.

Figure 7A:
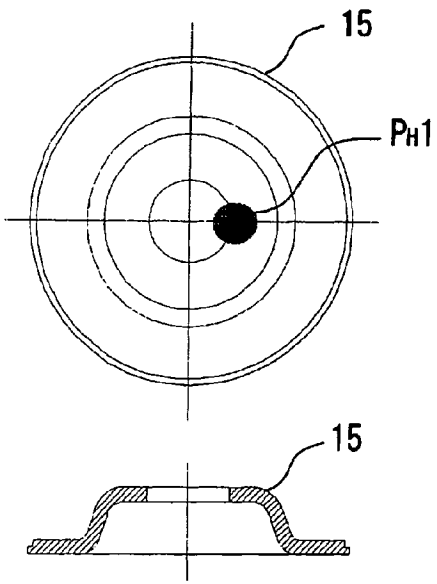
FIG. 7 is an explanatory view of an experiment conducted (on a diameter-direction measuring portion) about the magnetic field distortion thereof.
Figure 7B:
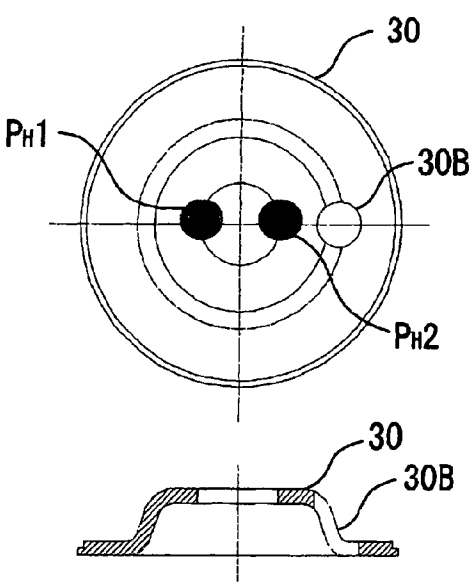
Figure 11:
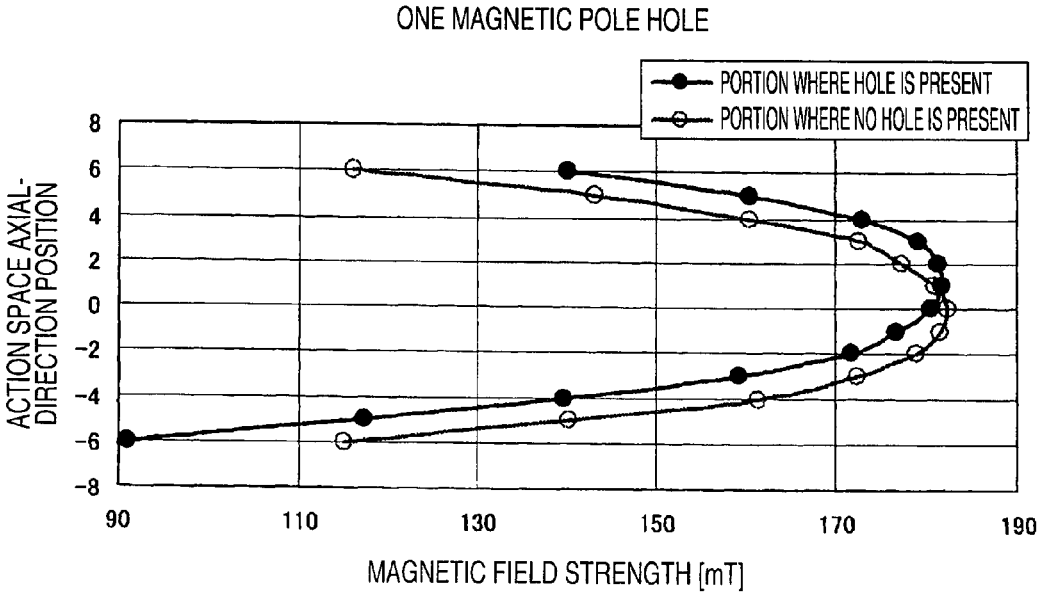
FIG. 11 is an explanatory view of an experiment conducted about the magnetic field distortion (a graph 2 showing the magnetic field strength measured results).

Also, FIG. 7B shows an input side pole piece having a penetration hole in addition to a penetration hole formed in the central portion thereof and two diameter-direction measuring portions Ph1 and Ph2 respectively corresponding to the two penetration holes. This input side pole piece is similar to the input side pole piece 30 according to the present embodiment and, therefore, reference numerals 30 and 30B are given to them, respectively. The diameter-direction measuring portion Ph1 is a portion in which no hole is formed, whereas the diameter-direction measuring portion Ph2 is a portion in which a hole is formed. FIG. 11 shows the results obtained by measuring the magnetic field strength, at their respective positions, in the respective axial-direction measuring portions Pv-8~pv8 respectively shown in FIG. 8.

Figure 7C:
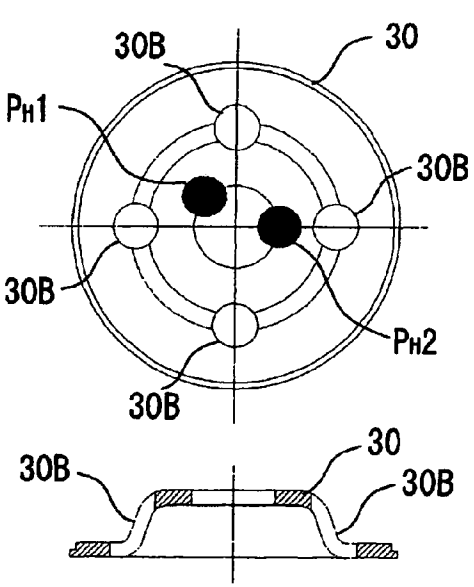
Figure 8:
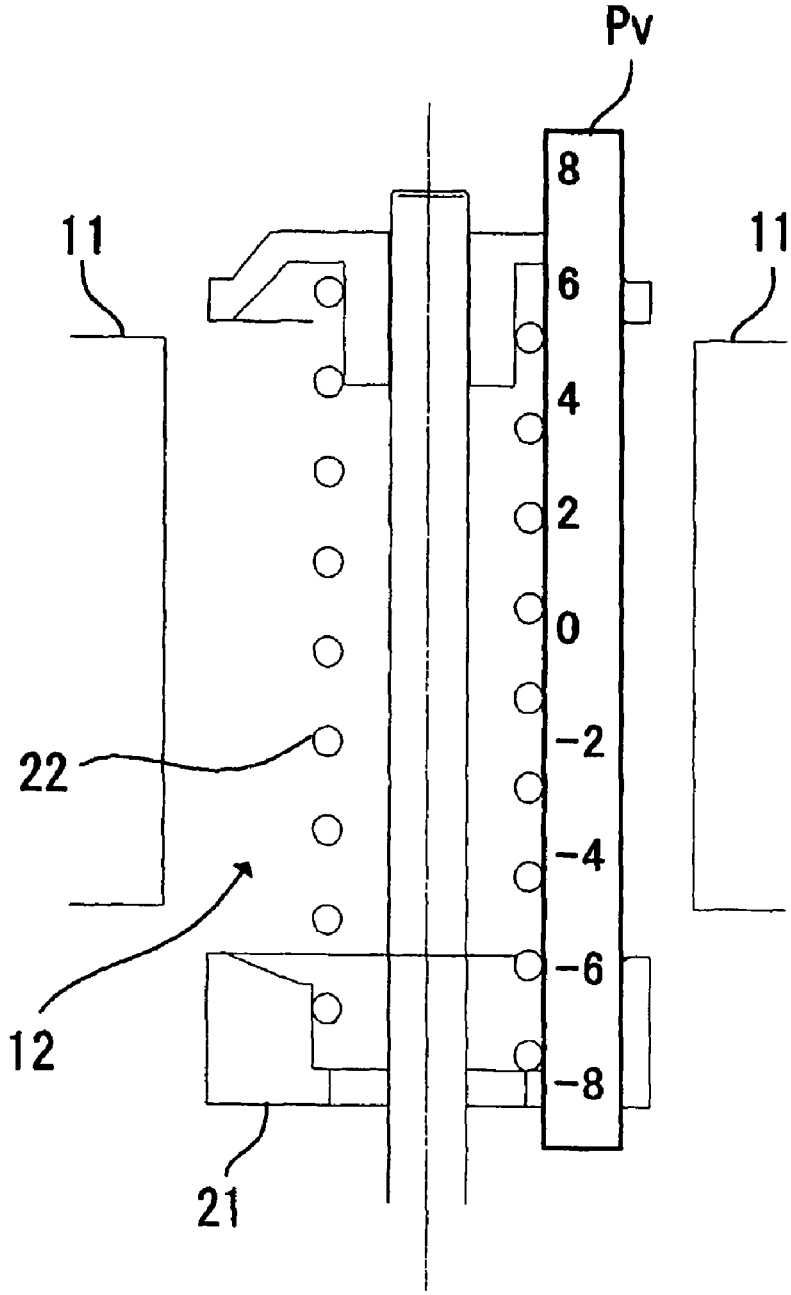
FIG. 8 is an explanatory view of an experiment conducted (on an axial-direction measuring portion) about the magnetic field distortion thereof.

Also, FIG. 7C shows an input side pole piece having four penetration holes in addition to a penetration hole formed in the central portion thereof and two diameter-direction measuring portions Ph1 and Ph2 respectively corresponding to these penetration holes. This input side pole piece is also similar to the input side pole piece 30 according to the present embodiment and, therefore, reference numerals 30 and 30B are given to them, respectively. The diameter-direction measuring portion Ph1 is a portion in which no hole is formed, whereas the diameter-direction measuring portion Ph2 is a portion in which a hole is formed. FIG. 11 shows the results obtained by measuring the magnetic field strength, at their respective positions, in the respective axial-direction measuring portions Pv-8~pv8 respectively shown in FIG. 8.

Now, FIG. 9 shows the measured results of the magnetic field strength in the respective cases shown in FIGS. 7A to 7C. In FIG. 9, in the case shown in 7A, the magnetic field strength in the axial-direction measuring portion Pv-6 is 127.3 mT, the magnetic field strength in the axial-direction measuring portion Pv-5 is 147.7 mT, the magnetic field strength in the axial-direction measuring portion Pv-4 is 166.3 mT, the magnetic field strength in the axial-direction measuring portion Pv-3 is 174.9 mT, the magnetic field strength in the axial-direction measuring portion Pv-2 is 180 mT, the magnetic field strength in the axial-direction measuring portion Pv-1 is 182.2 mT, the magnetic field strength in the axial-direction measuring portion Pv0 is 182.4 mT, the magnetic field strength in the axial-direction measuring portion Pv1 is 181.2 mT, the magnetic field strength in the axial-direction measuring portion Pv2 is 177.4 mT, the magnetic field strength in the axial-direction measuring portion Pv3 is 169.8 mT, the magnetic field strength in the axial-direction measuring portion Pv4 is 158.2 mT, the magnetic field strength in the axial-direction measuring portion Pv5 is 140 mT and the magnetic field strength in the axial-direction measuring portion Pv6 is 113.4 mT.

In the case shown in FIG. 7B, in the diameter-direction measuring portion P1 in which no hole is formed, the magnetic field strength in the axial-direction measuring portion Pv-6 is 115.1 mT, the magnetic field strength in the axial-direction measuring portion Pv-5 is 140.3 mT, the magnetic field strength in the axial-direction measuring portion Pv4 is 161.3 mT the magnetic field strength in the axial-direction measuring portion Pv-3 is 172.4 mT, the magnetic field strength in the axial-direction measuring portion Pv-2 is 178.9 mT, the magnetic field strength in the axial-direction measuring portion Pv-1 is 181.5 mT, the magnetic field strength in the axial-direction measuring portion Pv0 is 182.3 mT the magnetic field strength in the axial-direction measuring portion Pv1 is 180.9 mT, the magnetic field strength in the axial-direction measuring portion Pv2 is 177.3 mT the magnetic field strength in the axial-direction measuring portion Pv3 is 172.6 mT the magnetic field strength in the axial-direction measuring portion Pv4 is 160.4 mT the magnetic field strength in the axial-direction measuring portion Pv5 is 143.2 mT and the magnetic field strength in the axial-direction measuring portion Pv6 is 116.1 mT.

In the case shown in FIG. 7B, in the diameter-direction measuring portion P2 in which a hole is formed, the magnetic field strength in the axial-direction measuring portion Pv-6 is 140 mT, the magnetic field strength in the axial-direction measuring portion Pv-5 is 160 mT, the magnetic field strength in the axial-direction measuring portion Pv4 is 173 mT, the magnetic field strength in the axial-direction measuring portion Pv-3 is 179.2 mT, the magnetic field strength in the axial-direction measuring portion Pv-2 is 181.3 mT, the magnetic field strength in the axial-direction measuring portion Pv-1 is 181.8 mT, the magnetic field strength in the axial-direction measuring portion Pv0 is 180.5 mT, the magnetic field strength in the axial-direction measuring portion Pv1 is 176.8 mT, the magnetic field strength in the axial-direction measuring portion Pv2 is 171.8 mT, the magnetic field strength in the axial-direction measuring portion Pv3 is 159.2 mT, the magnetic field strength in the axial-direction measuring portion Pv4 is 139.7 mT, the magnetic field strength in the axial-direction measuring portion Pv5 is 117.2 mT, and the magnetic field strength in the axial-direction measuring portion Pv6 is 91 mT.

In the case shown in FIG. 7C, in the diameter-direction measuring portion P1 in which no hole is formed, the magnetic field strength in the axial-direction measuring portion Pv-6 is 115.8 mT, the magnetic field strength in the axial-direction measuring portion Pv-5 is 140.9 mT, the magnetic field strength in the axial-direction measuring portion Pv-4 is 161.2 mT, the magnetic field strength in the axial-direction measuring portion Pv-3 is 170.3 mT, the magnetic field strength in the axial-direction measuring portion Pv-2 is 176.3 mT, the magnetic field strength in the axial-direction measuring portion Pv-1 is 180.1 mT, the magnetic field strength in the axial-direction measuring portion Pv0 is 180.9 mT, the magnetic field strength in the axial-direction measuring portion Pv1 is 180.9 mT, the magnetic field strength in the axial-direction measuring portion Pv2 is 177.6 mT the magnetic field strength in the axial-direction measuring portion Pv3 is 172.1 mT the magnetic field strength in the axial-direction measuring portion Pv4 is 161.6 mT the magnetic field strength in the axial-direction measuring portion Pv5 is 144.9 mT, and the magnetic field strength in the axial-direction measuring portion Pv6 is 118.1 mT.

In the case shown in FIG. 7C, in the diameter-direction measuring portion P2 in which a hole is formed, the magnetic field strength in the axial-direction measuring portion Pv-6 is 116 mT, the magnetic field strength in the axial-direction measuring portion Pv-5 is 141.8 mT the magnetic field strength in the axial-direction measuring portion Pv-4 is 160.6 mT, the magnetic field strength in the axial-direction measuring portion Pv-3 is 171.3 mT, the magnetic field strength in the axial-direction measuring portion Pv-2 is 177.8 mT, the magnetic field strength in the axial-direction measuring portion Pv-1 is 180.4 mT the magnetic field strength in the axial-direction measuring portion Pv0 is 181.3 mT the magnetic field strength in the axial-direction measuring portion Pv1 is 180.4 mT, the magnetic field strength in the axial-direction measuring portion Pv2 is 177.1 mT the magnetic field strength in the axial-direction measuring portion Pv3 is 171.5 mT, the magnetic field strength in the axial-direction measuring portion Pv4 is 161.2 mT the magnetic field strength in the axial-direction measuring portion Pv5 is 144.6 mT, and the magnetic field strength in the axial-direction measuring portion Pv6 is 117.2 mT.

Figure 12:
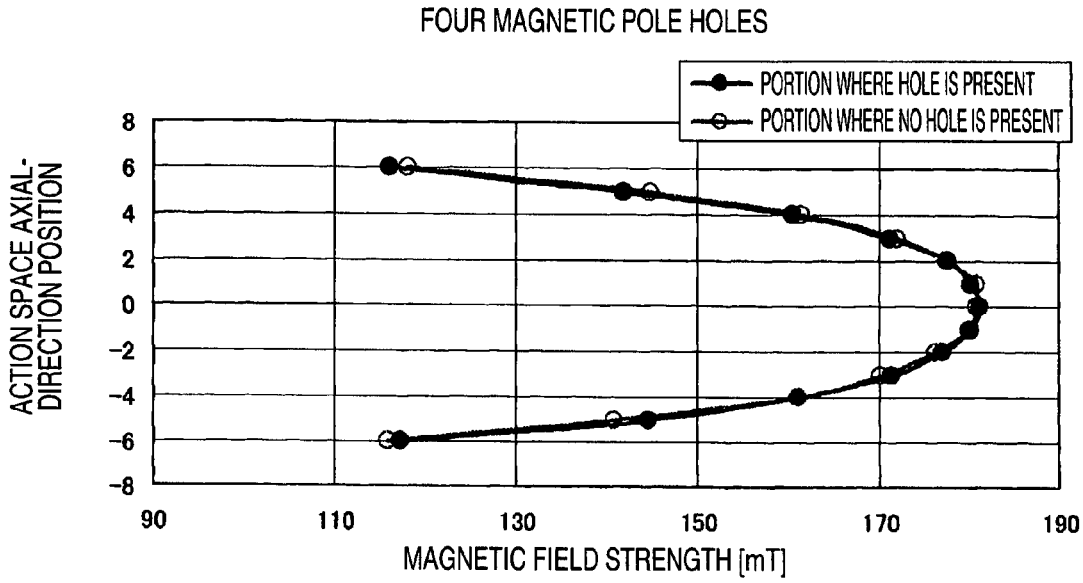
FIG. 12 is an explanatory view of an experiment conducted about the magnetic field distortion (a graph 3 showing the magnetic field strength measured results).

The results of FIG. 7B shown in FIG. 11 shows that, in the case where the number of the penetration hole 30B is one, the distribution of the magnetic field strength differs between the portion having a hole and the portion having no hole. On the other hand, the results of FIG. 7C shown in FIG. 12 shows that, in the case where the number of the penetration hole 30B is four, the distribution of the magnetic field strength differs little between the portion having the holes and the portion having no hole. Therefore, it can be judged that, preferably, there may be formed four penetration holes 30B.

Figure 13:
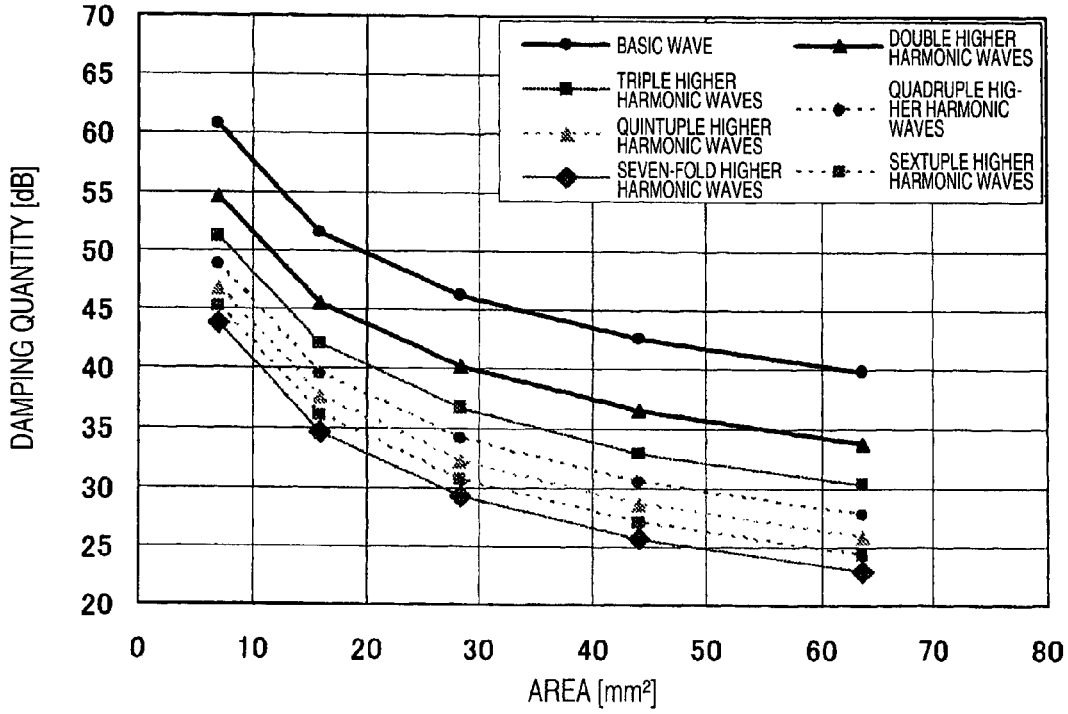
FIG. 13 is a graphical representation of results (the relationships between the hole area and damping quantity) obtained by an experiment conducted about the relationship between the hole diameters and higher harmonic waves.

Now, FIG. 13 is a graphical representation of the relationship of the damping quantity (dB) of higher harmonic waves with respect to the area of a hole when the plate thickness of an input side pole piece is 1.6 (mm). Generally, when the damping quantity is equal to or more than 30 (dB), it can be expected that the higher harmonic wave noise is hardly influenced. When the area of each penetration hole is taken into account, if the area of the hole is smaller than 27 ($mm^2$), the leakage of the higher harmonic wave noise has little influence on the worsening of the higher harmonic wave noise; but, if the area of the hole is equal to or larger than 27 ($mm^2$), there is a possibility that the higher harmonic wave noise can be worsened.

From the above-mentioned experimental results, it can be judged that the optimum value of the area of the penetration hole 30B to be able to provide a large air exhaust conductance without generating any distortion in the magnetic field distribution nor lowering the magnetic field strength is 16.6 ($mm^2$) or smaller.

Figure 14:
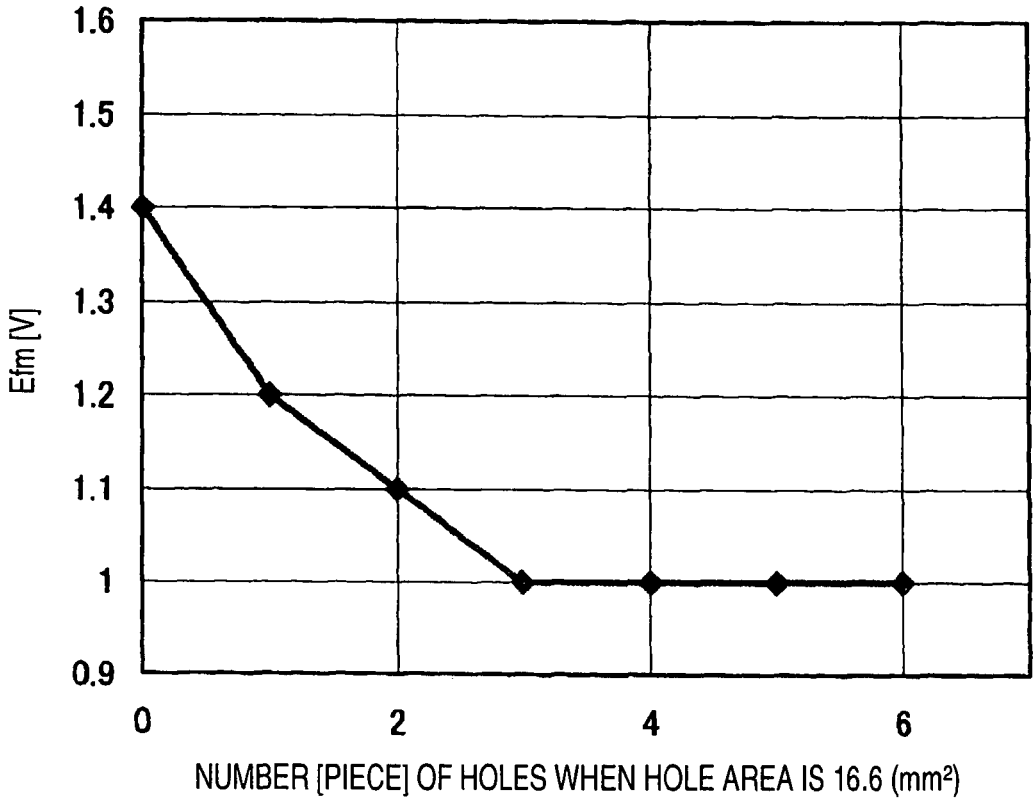
FIG. 14 is a graphical representation of the measured results of the hole number and Efm when the area of a hole formed in the input side pole piece is 16.6 ($mm^2$).
Figure 15:
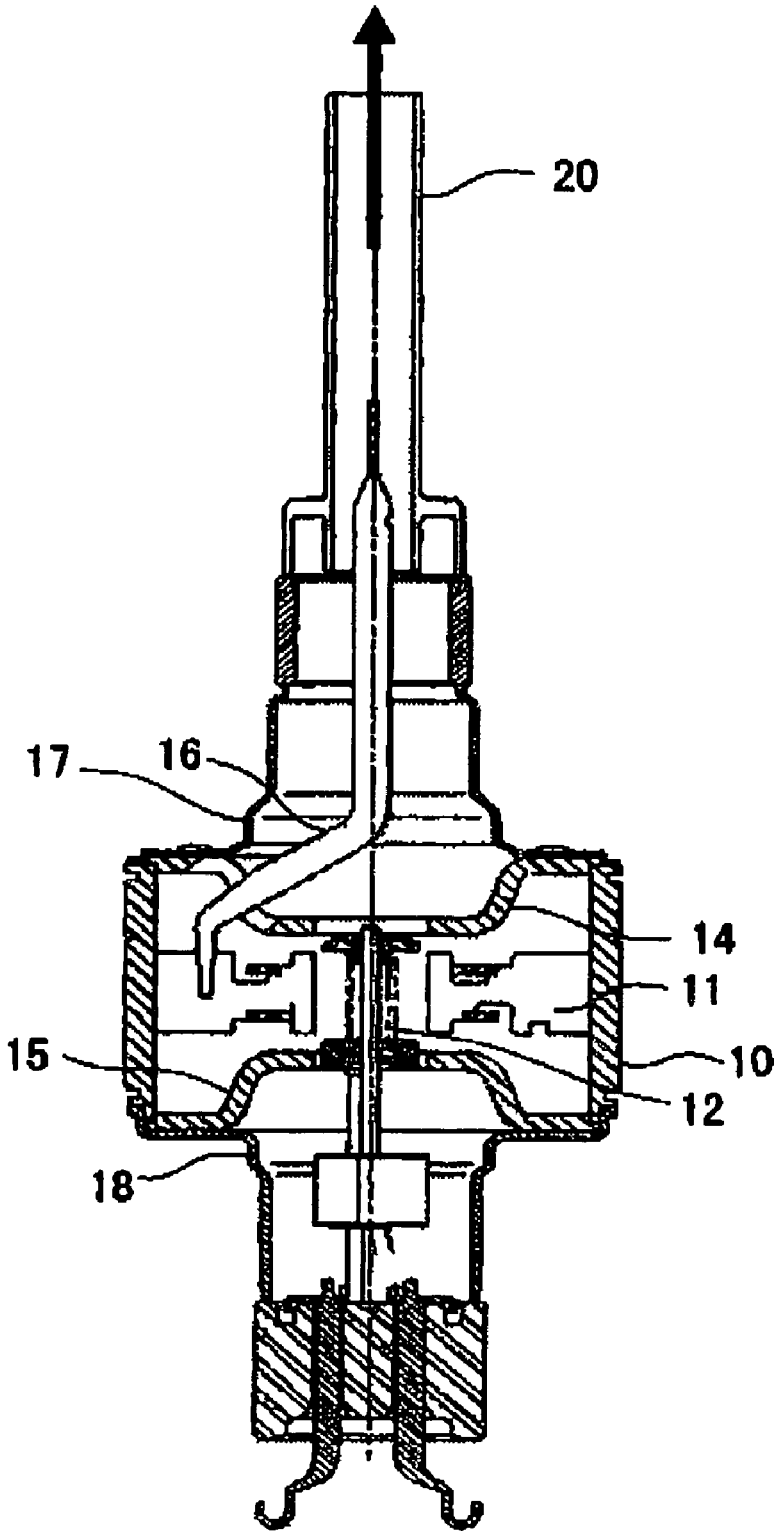
FIG. 15 is a longitudinal section view of a conventional magnetron.
Figure 16:
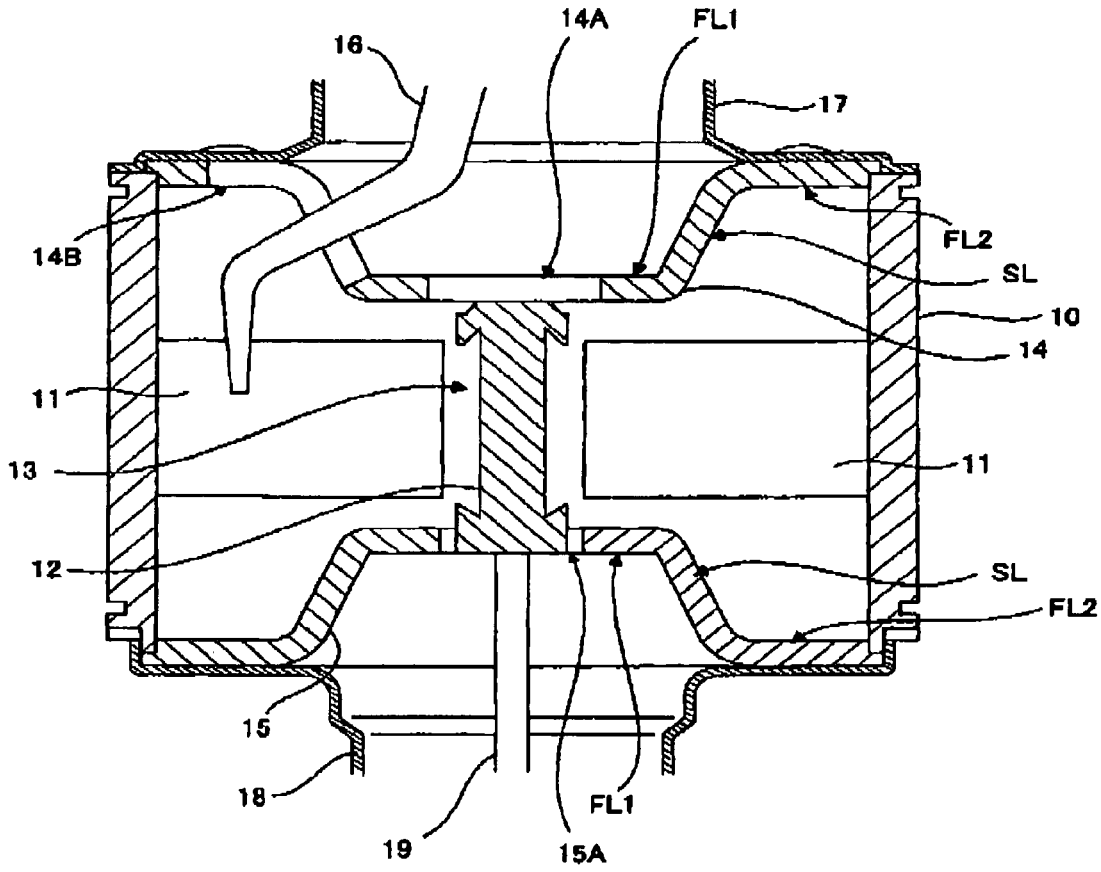
FIG. 16 is an enlarged section view of the main portions of the magnetron shown in FIG. 15.
Figure 17:
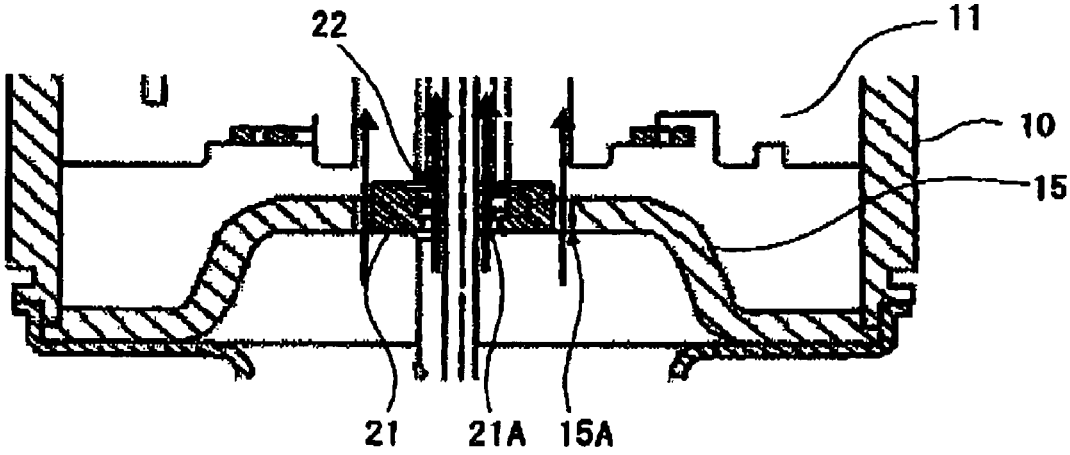
FIG. 17 is a view to show how the air passes in an input side pole piece employed in the magnetron shown in FIG. 15.

FIG. 14 shows the measured results of the hole number and Efm when the area of the hole of the input side pole piece is set 16.6 ($mm^2$). The Efm is one of the characteristics of the magnetron and is also a parameter which can tell whether the vacuum degree is good or not. As the vacuum degree is worsened, the Efm is increased. While the Efm of the conventional magnetron is 1.4 V, the Efm of a magnetron including two holes is 1.1 V and the Efm of a magnetron including three or more holes is 1.0 V, that is, it is stable. FIG. 14 shows that, when the number of holes is large, the vacuum degree of a magnetron is good. Execution of the exhaust of the air in a portion where the Efm is stable can prevent the occurrence of a poor vacuum degree.

As described above, according to the magnetron of the present embodiment, since, in the input side pole piece 30 disposed on the side where power is supplied to the cathode structure member 12, there are formed four penetration holes 30B each having an area of 16.6 $mm^2$ or smaller in the slanting portion SL in addition to the penetration hole 30A formed in the central portion of the input side pole piece 30, it is possible to provide a large air exhaust conductance, thereby being able to reduce the exhaust time necessary to discharge the air existing in the inside of the magnetron. And, because the air existing in the inside of the magnetron can be exhausted positively, the occurrence of the poor vacuum degree within the magnetron can be prevented. Also, by setting the area of each penetration hole 30B for 16.6 $mm^2$ or smaller, the lowering of the maximum magnetic field strength as well as the leakage of the higher harmonic waves can be prevented.

Also, since the respective penetration holes 30B are formed in the vertical direction (that is, in the axial direction of the input side pole piece) over the large-diameter flat portion FL2 and slanting portion SL, the penetration holes 30B can be produced simultaneously when the input side pole piece 30 is produced by press working. This can minimize an increase in the cost necessary for forming the respective penetration holes 30B.

The present invention provides an effect that the air exhaust conductance can be increased without lowering the maximum magnetic field strength or causing the leakage of the higher harmonic waves, and thus the invention can be used effectively as a microwave oscillation device for use in a microwave oven and the like.

What is claimed is:

1. A magnetron, comprising:

a cylindrical-shaped anode barrel member having two openings respectively formed in the two end portions thereof;

a cathode structure member disposed on the center axis of the anode barrel member;

more than one anode vane disposed radially through an action space in the periphery of the cathode structure member and fixedly mounted on the inner wall surface of the anode barrel member; and a funnel-shaped input side pole piece disposed on the side of one of the two openings of the anode barrel member for supply of power to the cathode structure member, the input side pole piece including a small-diameter flat portion having a penetration hole formed in the central portion thereof, a large-diameter flat portion having a diameter larger than the diameter of the small-diameter flat portion, and a conical-shaped slanting portion for connecting the large-diameter flat portion and small-diameter flat portion to each other, wherein the input side pole piece further includes, besides the penetration hole formed in the central portion of the small-diameter flat portion, three or more penetration holes respectively formed in the slanting portion thereof.

2. Microwave using equipment comprising a magnetron as set forth in claim 1.

3. A pole piece manufacturing method for manufacturing a magnetron comprising:

a cylindrical-shaped anode barrel member having two openings respectively formed in the two end portions thereof;

a cathode structure member disposed on the center axis of the anode barrel member;

more than one anode vane disposed radially through an action space in the periphery of the cathode structure member and fixedly mounted on the inner wall surface of the anode barrel member; and a funnel-shaped input side pole piece disposed on the side of one of the two openings of the anode barrel member for supply of power to the cathode structure member, the input side pole piece including a small-diameter flat portion having a penetration hole formed in the central portion thereof, a large-diameter flat portion having a diameter larger than the diameter of the small-diameter flat portion, and a conical-shaped slanting portion for connecting the large-diameter flat portion and small-diameter flat portion to each other, wherein there is formed a penetration hole over the large-diameter flat portion and slanting portion of the input side pole piece so as to extend in the axial direction of the input side pole piece.

4. The pole piece manufacturing method as set forth in claim 3, wherein the area of the penetration hole is 16.6 $mm^2$ or smaller and three or more such penetration holes are formed at given intervals in the peripheral direction of the slanting portion of the input side pole piece.

5. The pole piece manufacturing method as set forth in claim 3, wherein:

the magnetron further includes a metal ring, and the large-diameter flat portion rests on the metal ring.

* * * * *